US010365042B2

(12) United States Patent
Kozono et al.

(10) Patent No.: US 10,365,042 B2
(45) Date of Patent: Jul. 30, 2019

(54) TRAY AND HEAT TREATMENT METHOD

(71) Applicant: MITSUI HIGH-TEC, INC., Kitakyushu-shi, Fukuoka (JP)

(72) Inventors: Takeaki Kozono, Fukuoka (JP); Yusuke Hasuo, Fukuoka (JP)

(73) Assignee: MITSUI HIGH-TEC, INC., Fukuoka (JP)

( * ) Notice: Subject to any disclaimer, the term of this patent is extended or adjusted under 35 U.S.C. 154(b) by 76 days.

(21) Appl. No.: 15/431,862

(22) Filed: Feb. 14, 2017

(65) Prior Publication Data

US 2017/0248367 A1 Aug. 31, 2017

(30) Foreign Application Priority Data

Feb. 26, 2016 (JP) ..... 2016-035915

(51) Int. Cl.
*F27D 3/12* (2006.01)
*F27D 5/00* (2006.01)

(52) U.S. Cl.
CPC ..... *F27D 3/12* (2013.01); *F27D 5/00* (2013.01); *F27D 2003/124* (2013.01); *F27D 2005/0081* (2013.01)

(58) Field of Classification Search
CPC ..... F27D 3/12; F27D 5/00
See application file for complete search history.

(56) References Cited

U.S. PATENT DOCUMENTS 1,513,617 A * 10/1924 Litt ..... C04B 33/32 264/605
2,168,333 A * 8/1939 Harris ..... C21D 9/0025 432/261
3,469,686 A * 9/1969 Gutsche ..... H01L 21/67346 206/518
3,499,634 A * 3/1970 Rea ..... F27D 5/005 264/317
3,778,224 A * 12/1973 Duffner ..... F27D 5/005 432/258
4,354,830 A * 10/1982 Gamble ..... F27D 5/005 432/258

(Continued)

FOREIGN PATENT DOCUMENTS

CN 101201185 6/2008
CN 101845545 9/2010

(Continued)

OTHER PUBLICATIONS

Office Action issued in Canada Counterpart Patent Appl. No. 2958486, dated Mar. 21, 2018.

(Continued)

*Primary Examiner* — Nathaniel Herzfeld
(74) *Attorney, Agent, or Firm* — Greenblum & Bernstein, P.L.C.

(57) ABSTRACT

A tray is provided for conveying a workpiece placed on the tray inside a heat treatment furnace. The tray includes plural kinds of positional displacement regulating parts for respectively regulating horizontal positional displacements of plural kinds of workpieces with different sizes, wherein the plural kinds of positional displacement regulating parts are arranged concentrically in a plane shape.

20 Claims, 7 Drawing Sheets

(56) References Cited

U.S. PATENT DOCUMENTS

| | | | | | |
|---|---|---|---|---|---|
| 4,722,440 | A * | 2/1988 | Johnston | B65D 71/70 | 206/319 |
| 4,978,109 | A * | 12/1990 | Vigouroux | C21D 9/0025 | 266/258 |
| 5,149,264 | A * | 9/1992 | Horikawa | B28B 11/243 | 432/2 |
| 5,613,848 | A * | 3/1997 | Hashimoto | F26B 25/18 | 248/309.1 |
| 5,752,821 | A * | 5/1998 | Jo | C21D 9/0025 | 269/54.5 |
| 6,202,883 | B1 * | 3/2001 | Narazaki | H01L 21/67333 | 206/706 |
| 6,939,131 | B2 * | 9/2005 | Maumus | C21D 9/0025 | 248/346.01 |
| 7,059,476 | B2 * | 6/2006 | Kunii | B65D 21/00 | 206/503 |
| 2006/0263552 | A1 * | 11/2006 | Tsuji | B32B 3/02 | 428/34.4 |

FOREIGN PATENT DOCUMENTS

| | | |
|---|---|---|
| CN | 202116598 | 1/2012 |
| CN | 202730220 | 2/2013 |
| CN | 103754457 | 4/2014 |
| CN | 104108034 | 10/2014 |
| CN | 204068595 | 12/2014 |
| CN | 105316621 | 2/2016 |
| JP | 7-42508 | 2/1995 |
| JP | 11-332183 | 11/1999 |
| JP | 2003-113421 | 4/2003 |
| JP | 2008-38194 | 2/2008 |
| JP | 2009-249649 | 10/2009 |
| JP | 2014-80240 | 5/2014 |

OTHER PUBLICATIONS

Office Action issued in CHINA Counterpart Patent Appl. No. 201710108497.2, dated Apr. 17, 2018 , along with an English translation thereof.

* cited by examiner

TRAY AND HEAT TREATMENT METHOD

CROSS REFERENCE TO RELATED APPLICATION

This application is based upon and claims the benefit of priority of Japanese Patent Application No. 2016-035915 filed on Feb. 26, 2016, the contents of which are incorporated herein by reference in its entirety.

BACKGROUND OF THE INVENTION

1. Field of the Invention

The present invention relates to a tray carried in and out of a heat treatment furnace together with a workpiece placed on the tray, and a heat treatment method using the tray.

2. Description of the Related Art

Heat treatment is a generic term of treatment in which properties of a workpiece are changed by heating or cooling. The heat treatment includes quenching, tempering, annealing, normalizing, oil quenching, blackening treatment, etc. (see JP-A-2003-113421 as Patent Literature 1). In a manufacturing step of a laminated iron core such as an armature iron core of an electric motor or a generator, various items of heat treatment are conducted. For example, the oil quenching, the annealing, the blackening treatment, etc. are conducted. The oil quenching is treatment in which the oil content such as stamping oil adhering to a surface of a prime plate is evaporated and removed in a processing step. The annealing is also called drawing back, and is treatment in which an internal stress or a strain of the prime plate is removed (see JP-A-11-332183 as Patent Literature 2). The blackening treatment is also called bluing, and is treatment in which a coating (so-called black rust) of triiron tetroxide ($Fe_3O_4$) is produced on the surface of the prime plate for rust prevention. The oil quenching, the annealing and the blackening treatment may also be conducted continuously. For example, FIG. 1 of JP-B-7-42508 as Patent Literature 3 discloses a continuous annealing and bluing apparatus in which a deoiling furnace 2, an annealing furnace 3 and a bluing furnace 4 are connected by a conveyance path 1 and a workpiece is carried in and out of each of the furnaces.

JP-A-2003-113421 mentions that many workpieces are placed on a conveyance jig and are carried in a heat treatment furnace and are heat-treated and then are out of the heat treatment furnace and are conveyed to the next step. The conveyance jig is also called a tray or a pallet, and is generally constructed in a grid shape so that the workpieces are equally heated and cooled (see JP-A-2003-113421 as Patent Literatures 1, JP-A-2008-38194 as Patent Literature 4, and JP-A-2009-249649 as Patent Literature 5).

Patent Literature 1: JP-A-2003-113421
Patent Literature 2: JP-A-11-332183
Patent Literature 3: JP-B-7-42508
Patent Literature 4: JP-A-2008-38194
Patent Literature 5: JP-A-2009-249649

SUMMARY OF THE INVENTION

Such a tray (conveyance jig) includes a positional displacement regulating part so as to prevent the workpieces from being unequally heat-treated or being damaged due to contact between the mutual workpieces in a process of heat treatment or a process of conveyance, and regulates a horizontal positional displacement of the workpiece with respect to the tray. The positional displacement regulating part is, for example, a recess or a protrusion formed according to a plane shape of the workpiece.

Since this positional displacement regulating part must be formed according to the plane shape of the workpiece, it is necessary to prepare a dedicated tray every type of workpiece. As a result, in a heat treatment line in which many types are mixed and processed, it is necessary to prepare space for storing many kinds of trays inside a factory, with the result that there is a problem of decreasing use efficiency of the space of the factory. Also, since the tray placed on the line is changed every time the type targeted for processing is changed, setup change time is required, with the result that there is a problem of decreasing efficiency.

The present invention has been implemented in view of such circumstances, and a non-limited object of the present invention is to provide a tray capable of conveying plural kinds of workpieces with different dimensions or shapes in the tray for carrying the placed workpieces in and out of a heat treatment furnace. Also, another non-limited object of the present invention is to provide a heat treatment method capable of preventing the workpieces from being deformed or being damaged in a heat treatment process or during conveyance of the plural kinds of workpieces with the different dimensions or shapes.

An aspect of the present invention provides a tray for conveying a workpiece placed on the tray inside a heat treatment furnace, the tray including: plural kinds of positional displacement regulating parts for respectively regulating horizontal positional displacements of plural kinds of workpieces with different sizes, wherein the plural kinds of positional displacement regulating parts are arranged concentrically in a plane shape.

The positional displacement regulating parts may be arranged on an upper surface and a lower surface of the tray.

At least one of the positional displacement regulating parts may be a recess formed so as to surround a whole periphery of a contour of the workpiece in the plane shape. At least one of the positional displacement regulating parts may include a plurality of projections formed so as to surround a part of a contour of the workpiece in the plane shape.

Another aspect of the present invention provides a heat treatment method including: placing a workpiece on the tray; carrying the workpiece together with the tray in a heat treatment furnace; heat-treating the workpiece in the heat treatment furnace; and then carrying the workpiece together with the tray out of the heat treatment furnace.

Before the workpiece is placed on the tray, a plate with a size corresponding to the workpiece may be placed on the tray and the workpiece may be placed on the plate.

After the workpiece is placed on the tray, a pin may be inserted from an upper surface of the workpiece and a tip of the pin may be fixed to the tray.

After the workpiece is placed on the tray, a different workpiece with a different size may be placed on an upper surface of the workpiece.

A pin may be inserted from an upper surface of the different workpiece and the pin may be inserted into the different workpiece and the workpiece.

A first workpiece, which is formed in an annular shape in a plane shape and is constructed in a generally tubular shape, may be placed on the tray, a second workpiece may be arranged inside the tube of the first workpiece and placed on the tray, and the first and second workpieces may be respectively engaged with different positional displacement regulating parts.

Trays on which the workpieces are placed may be laminated in plural stacks and the trays may be carried in and out of the heat treatment furnace.

Since the tray according the aspect of the present invention includes the plural kinds of positional displacement regulating parts for respectively regulating the horizontal positional displacements of the plural kinds of workpieces with the different sizes in the tray, the plural kinds of workpieces with the different sizes can be conveyed by the single tray. As a result, it becomes unnecessary to prepare the dedicated tray every type of workpiece. Consequently, space for storing the tray can be decreased. As a result, use efficiency of the space in a factory is increased. Also, since it becomes unnecessary to replace the tray every time the workpiece is changed, setup change time is shortened and productivity is increased.

Also, since the heat treatment method according to the aspect of the present invention can prevent the workpieces from being deformed or being damaged in a heat treatment process or during conveyance of the plural kinds of workpieces with the different sizes, quality of a product is improved.

BRIEF DESCRIPTION OF THE DRAWINGS

In the accompanying drawings:

FIGS. 1A and 1B are explanatory diagrams showing a configuration of a tray according to an embodiment of the present invention, in which FIG. 1A is a plan view of the tray, and FIG. 1B is a sectional view in the case of cutting the tray by a cross section shown by line IB-IB' in FIG. 1A;

FIGS. 5A and 5B show a further modified example of the placement part, in which FIG. 5A is a plan view of the placement part, and FIG. 5B is a side view of the placement part;

FIGS. 6A to 6C are diagram s describing a heat treatment method according to the embodiment of the present invention, in which FIG. 6A is a diagram showing a state in which a laminated iron core is placed on the tray, FIG. 6B is a diagram showing a state in which the trays are vertically laminated, and FIG. 6C is a diagram showing an apparatus for carrying the laminated trays and the laminated iron cores in and out of an annealing furnace;

FIGS. 12A and 12B show a further modified example of the placement part, in which FIG. 12A is a plan view of the placement part, and FIG. 12B is a sectional view in the case of cutting the placement part by a cross section shown by line C-C' in FIG. 12A.

DETAILED DESCRIPTION OF THE EXEMPLARY EMBODIMENTS

A tray and a heat treatment method according to an embodiment of the present invention will hereinafter be described in detail with reference to the accompanying drawings.

Figure 1A:
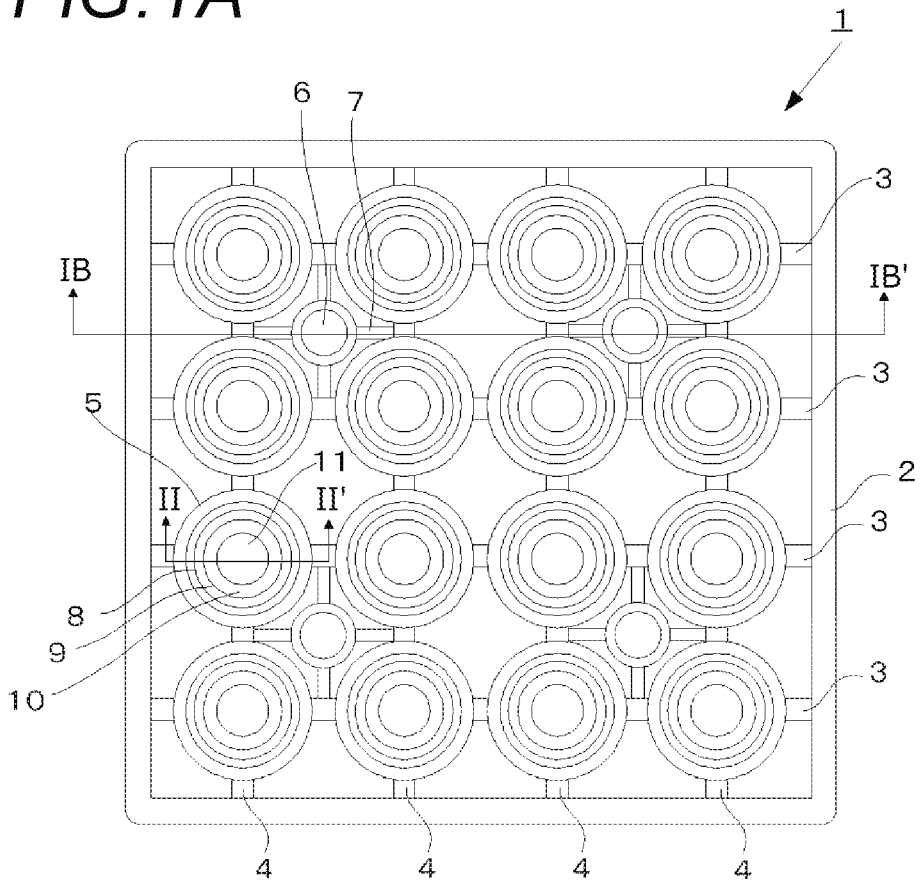
Figure 1B:
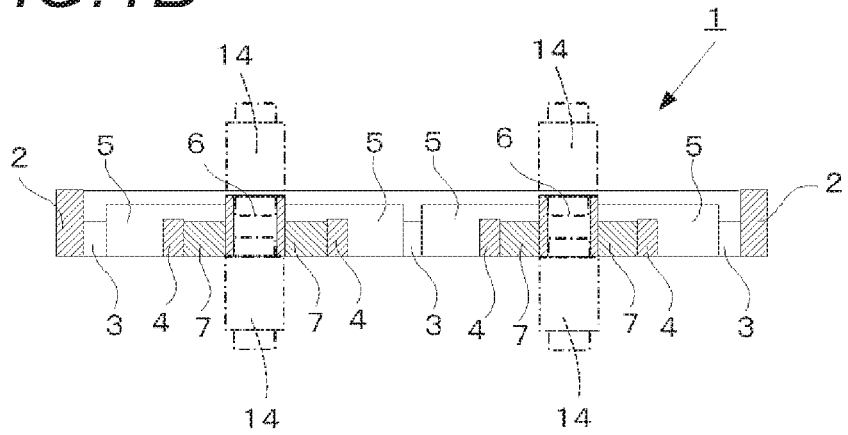

FIGS. 1A and 1B are explanatory diagrams showing a configuration of a tray 1 according to the embodiment of the present invention. As shown in FIG. 1A, the tray 1 includes an, outer frame 2 with a rectangular shape in plan view. Four transverse beams 3 and four longitudinal beams 4 are respectively arranged in a grid shape inside the outer frame 2. Both ends of the transverse beams 3 and the longitudinal beams 4 are coupled to the outer frame 2, and a total of sixteen placement parts 5 are fixed to points of intersections between the transverse beams 3 and the longitudinal beams 4. That is, the placement parts 5 are coupled to the outer frame 2 through the transverse beams 3 and the longitudinal beams 4. In addition, a function and a detailed configuration of the placement part 5 will be described below. Also, in FIG. 1A, in order to avoid complication, numerals are assigned to only limited parts of the transverse beams 3, the longitudinal beams 4 and the placement parts 5 and description of the numerals is omitted partially.

Also, the tray 1 includes four support tubes 6. These support tubes 6 are arranged between the placement parts 5, and are fixed to the transverse beams 3 and the longitudinal beams 4 through four brackets 7, respectively. The support tube 6 is a member with a hollow cylindrical shape as shown in FIG. 1B. Also, an adapter 14 is fitted into an upper end or a lower end of the support tube 6 in the case of laminating the trays 1 in plural stacks. Detailed functions of the adapter 14 and the support tubes 6 will be described below.

Returning to FIG. 1A, the detailed configuration and function of the placement part 5 will be described. As shown in FIG. 1A, the placement part 5 includes a first positional displacement regulating part 8, a second positional displacement regulating part 9 and a third positional displacement regulating part 10 for regulating horizontal positional displacements of workpieces A to C (not shown in FIG. 1A) with different dimensions, respectively. The second positional displacement regulating part 9 is arranged concentrically inside the first positional displacement regulating part 8. Also, the third positional displacement regulating part 10 is arranged concentrically inside the second positional displacement regulating part 9. That is, the first to third positional displacement regulating parts 8 to 10 are arranged mutually concentrically. Also, a through hole 11 is formed inside the third positional displacement regulating part 10. Also, the through hole 11 is arranged concentrically with the first to third positional displacement regulating parts 8 to 10.

Figure 2:
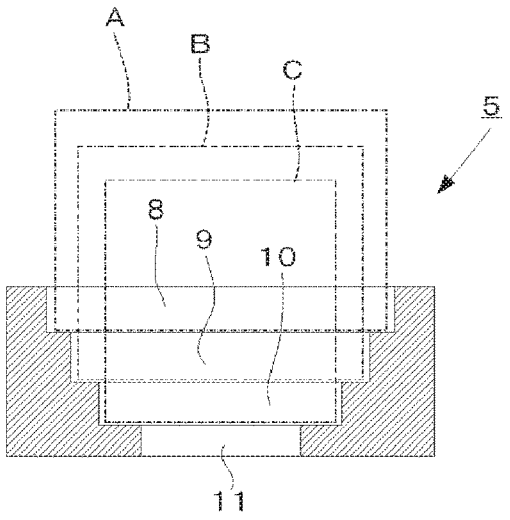
FIG. 2 is a sectional view in the case of cutting a placement part included by the tray described in FIG. 1 by a cross section shown by line II-II' in FIG. 1A.

FIG. 2 is a sectional view in the case of cutting the placement part 5 by a cross section shown by line II-II' in FIG. 1A. As shown in FIG. 2, the first positional displacement regulating part 8 is a recess lowered by one step from the upper end of the placement part 5. The second positional displacement regulating part 9 is a recess further lowered by one step from the first positional displacement regulating part 8. The third positional displacement regulating part 10 is a recess further lowered by one step from the second positional displacement regulating part 9. Also, the through hole 11 is formed in the center of the third positional displacement regulating part 10. Also, diameters of the first to third positional displacement regulating parts 8 to 10 are formed smaller in order from the first positional displacement regulating part 8, and a diameter of the through hole 11 is formed smaller than that of the third positional displacement regulating part 10. As a result, the placement part 5 is formed with a stepwise step in a cross section shape shown in FIG. 2.

As described above, the first to third positional displacement regulating parts 8 to 10 are regions for regulating the horizontal positional displacements of the workpieces A to C with the different dimensions, respectively. Because of this, the diameters of the first to third positional displacement regulating parts 8 to 10 are respectively set in sizes in which gaps are added to diameters of the workpieces A to C as shown in FIG. 2. When the workpiece A is placed on the placement part 5, the workpiece A is supported with the workpiece A abutting on a bottom surface of the first positional displacement regulating part 8. At this time, the horizontal positional displacement of the workpiece A is allowed in the range of a difference (gap) between the diameter of the first positional displacement regulating part 8 and the diameter of the workpiece A, and when a side surface of the workpiece A abuts on a side wall of the first positional displacement regulating part 8, the workpiece A is stopped in that place. That is, the horizontal positional displacements of the workpiece A exceeding an allowable range is regulated. As a result, the workpiece A can be prevented from making contact with the workpiece A placed on another adjacent placement part 5 during conveyance or in a treatment process. Similarly, the workpiece B is supported with the workpiece B abutting on a bottom surface of the second positional displacement regulating part 9. The workpiece C is supported with the workpiece C abutting on a bottom surface of the third positional displacement regulating part 10. And, the horizontal positional displacement of the workpiece B is regulated by the second positional displacement regulating part 9, and the horizontal positional displacement of the workpiece C is regulated by the third positional displacement regulating part 10, respectively. Thus, the placement part 5 can place the three kinds of workpieces A to C with the different dimensions and regulate the horizontal positional displacements of the workpieces A to C.

Figure 3:
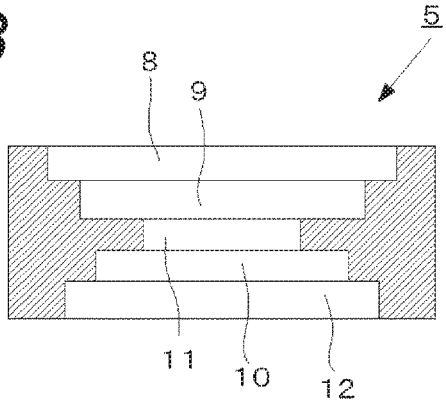
FIG. 3 is a sectional view corresponding to FIG. 2, which shows a modified example of the placement part.

The tray 1 can be constructed so that the tray 1 can be vertically reversed and used. For example, as shown in FIG. 3, it may be constructed so that the placement part 5 is formed with the first to third positional displacement regulating parts 8 to 10 and a fourth positional displacement regulating part 12 and the through hole 11 is arranged between the second positional displacement regulating part 9 and the third positional displacement regulating part 10. In this case, in an erect state (state shown in FIG. 3), a workpiece (not shown) is placed on the first positional displacement regulating part 8 or the second positional displacement regulating part 9. When the placement part 5 is vertically reversed, the workpiece (not shown) can be placed on the third positional displacement regulating part 10 or the fourth positional displacement regulating part 12. Thus, when the placement part 5 is constructed as shown in FIG. 3, by reversing the tray 1, a total of four kinds of workpieces with different dimensions can be placed to regulate horizontal positional displacements of the four kinds of workpieces.

Figure 4:
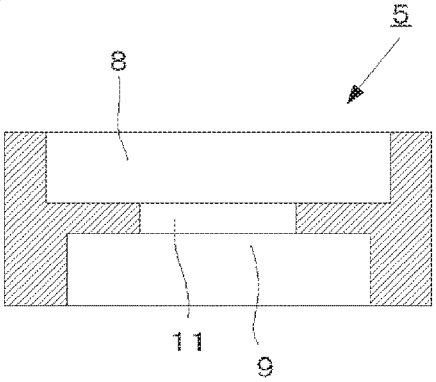
FIG. 4 is a sectional view corresponding to FIGS. 2 and 3, which shows another modified example of the placement part.

Also, as shown in FIG. 4, it may be constructed so that the placement part 5 is formed with the first positional displacement regulating part 8 and the second positional displacement regulating part 9 and the through hole 11 is arranged between the first positional displacement regulating part 8 and the second positional displacement regulating part 9. In this case, in an erect state (state shown in FIG. 4), a workpiece (not shown) is placed on the first positional displacement regulating part 8. When the placement part 5 is vertically reversed, the workpiece (not shown) can be placed on the second positional displacement regulating part 9. Thus, when the placement part 5 is constructed as shown in FIG. 4, by reversing the tray 1, two kinds of workpieces with different dimensions can be placed to regulate horizontal positional displacements of the two kinds of workpieces.

The example in which the placement part 5 is formed with the recess so as to surround the whole periphery of a contour of the workpiece in a plane shape and the recess is used as the positional displacement regulating part is shown above. However, the positional displacement regulating part is not limited to the parts constructed by the recess.

Figure 5A:
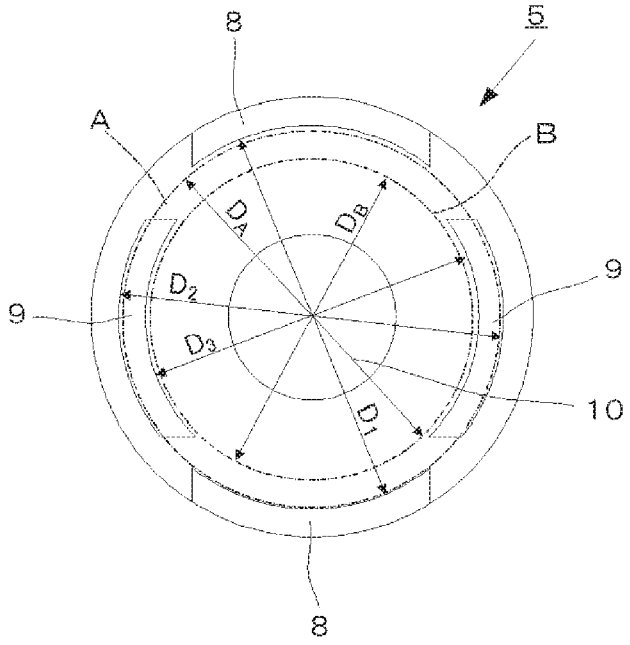
Figure 5B:
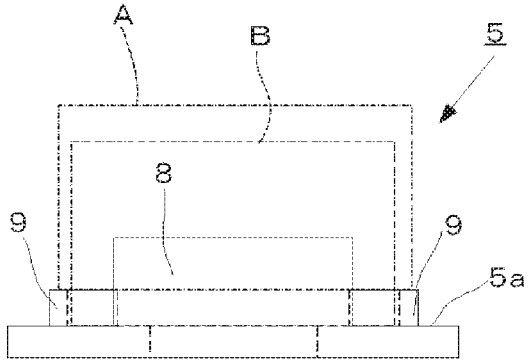

FIGS. 5A and 5B are explanatory diagrams showing another configuration example of the placement part 5, in which FIG. 5A is a plan view of the placement part 5, and FIG. 5B is a side view of the placement part 5. As shown in FIG. 5A, also in this placement part 5, the first positional displacement regulating part 8 and the second positional displacement regulating part 9 are arranged concentrically in the plane shape. And, it is constructed so that the first positional displacement regulating part 8 regulates a horizontal positional displacement of the workpiece A and the second positional displacement regulating part 9 regulates a horizontal positional displacement of the workpiece B. However, the configuration example shown in FIG. 5 differs from the configuration examples shown in FIGS. 2 to 4 in the following point.

As shown in FIG. 5A, the first positional displacement regulating parts 8 include two members having a circular arc with an inside diameter $D_1$ in the plane shape, and are spaced in an up-and-down direction in FIG. 5A. As a result, all the contour of the workpiece A is not surrounded by the first positional displacement regulating parts 8. That is, a part of the contour of the workpiece A is surrounded by the first positional displacement regulating parts 8. In addition, the inside diameter $D_1$ of the first positional displacement regulating parts 8 is larger than an outside diameter $D_A$ of the workpiece A ($D_1>D_A$). As a result, the first positional displacement regulating parts 8 can regulate the horizontal positional displacement of the workpiece A.

Also, the second positional displacement regulating parts 9 include two members having a circular arc in the plane shape, and are spaced in a left-right direction in FIG. 5A. As a result, all the contour of the workpiece B is not surrounded by the second positional displacement regulating parts 9. That is, a part of the contour of the workpiece A is surrounded by the second positional displacement regulating parts 9. In addition, an outside diameter of the second positional displacement regulating parts 9 is $D_2$ and an inside diameter of the second positional displacement regulating parts 9 is $D_3$. The inside diameter $D_3$ of the second positional displacement regulating parts 9 is larger than an outside diameter $D_B$ of the workpiece B ($D_3>D_B$). As a result, the second positional displacement regulating parts 9 can regulate the horizontal positional displacement of the workpiece B.

As shown in FIG. 5B, the first positional displacement regulating parts 8 and the second positional displacement regulating parts 9 are projections bulged from the placement part 5. And, the upper end of the first positional displacement regulating part 8 is in a position higher than the upper end of the second positional displacement regulating part 9. Also, as shown in FIG. 5B, the outside diameter $D_2$ of the second positional displacement regulating parts 9 is larger than the outside diameter $D_A$ of the workpiece A ($D_2>D_A$). As a result, a lower surface of the workpiece A is supported with the lower surface of the workpiece A abutting on upper end surfaces of the second positional displacement regulating parts 9. A lower surface of the workpiece B is supported with the lower surface of the workpiece B abutting on a board upper surface 5*a* of the placement part 5.

Since the placement part 5 is constructed in this manner, also in the placement part 5 described in FIGS. 5A and 5B, two kinds of workpieces A, B with different dimensions can be placed to regulate the horizontal positional displacements of the workpieces A, B. In addition, in the placement part 5 described in FIGS. 5A and 5B, a lower surface of the placement part 5 may be formed with the positional displacement regulating part.

The configuration and action of the tray 1 are described above, and the tray 1 is used in heat treatment of the workpiece. Hereinafter, a concrete example of the heat treatment conducted using the tray 1 is illustrated. In addition, hereinafter, an example in which a laminated iron core 13 constructing an armature of a rotating electrical machine is put into an annealing furnace 15 and is annealed is shown.

Figure 6A:
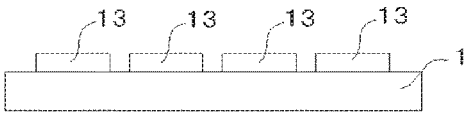
Figure 6B:
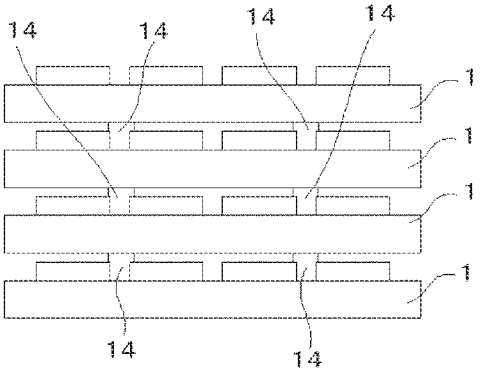

In the case of conducting annealing treatment of the laminated iron core 13, as shown in FIG. 6A, the laminated iron core 13 is first placed on the tray 1. A total of sixteen laminated iron cores 13 are placed on the tray 1. The laminated iron core 13 may be placed manually by a worker, or by an autoloader or a robot. The annealing treatment of many laminated iron cores 13 is conducted collectively. For that purpose, the trays 1 on which the laminated iron cores 13 are placed are stacked up vertically. At this time, the adapter 14 is attached to an upper part of the support tube 6 of the tray 1 placed on the lowermost layer. The adapter 14 is a rod-shaped member for mutually joining the support tubes 6 and also adjusting a vertical height of the tray 1. As shown in FIG. 1B, dimensions and shapes of the upper and lower ends of the adapter 14 are configured to be fitted into the support tube 6. After the adapter 14 is attached to the support tube 6 of the tray 1 placed on the lowermost layer, another tray 1 is placed thereon, and the upper end of the adapter 14 is fitted into the lower end of the support tube 6 of its tray 1. Then, another adapter 14 is attached to the upper part of the support tube 6 of its tray 1. This is repeated to thereby complete a laminated body of the trays 1 as shown in FIG. 6B.

Figure 6C:
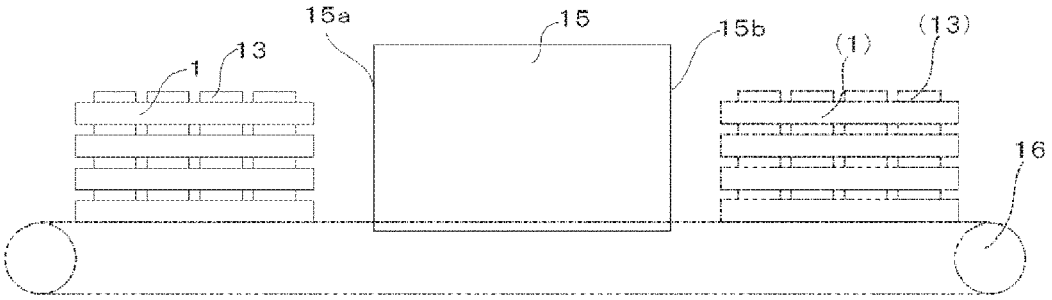

As shown in FIG. 6C, the annealing furnace 15 is configured in a generally tunnel shape, and includes a carry-in port 15*a* in the left side and a carry-out port 15*b* in the right side in FIG. 6C. Also, a chain conveyor 16 for conveying an object targeted for annealing from the left side of the annealing furnace 15 to the right side of the annealing furnace 15 through the annealing furnace 15 is arranged. The laminated body of the trays 1 is conveyed by the chain conveyor 16 and is carried in the annealing furnace 15. The laminated iron cores 13 are annealed inside the annealing furnace 15 and then are carried out together with the trays 1. That is, the laminated iron cores 13 are conveyed to a position shown by an imaginary line in FIG. 6C.

According to the heat treatment method described above, the laminated iron cores 13 are placed on the tray 1 and are conveyed and heat-treated, with the result that horizontal positional displacements of the laminated iron cores 13 in a heat treatment process or during conveyance are prevented. As a result, the laminated iron cores 13 are prevented from being deformed or being damaged, and quality of the laminated iron cores 13 after the heat treatment is improved. Also, a similar effect can be obtained in plural kinds of laminated iron cores 13 with the different sizes.

Figure 7:
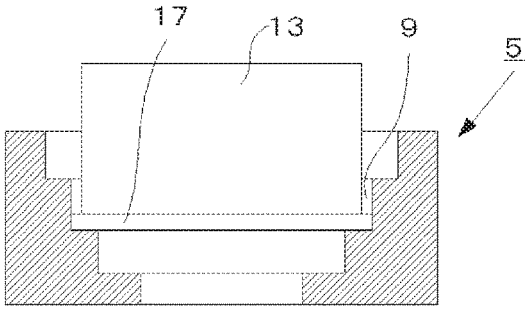
FIG. 7 is a diagram describing a modified example of the heat treatment method, and is a sectional view showing a state in which a plate is attached to the placement part and a laminated iron core is placed on the plate.

Normally, the workpiece is directly placed on the placement part 5, but a plate may be placed on the placement part 5 to place the workpiece on its plate. For example, as shown in FIG. 7, a plate 17 configured to be fitted into the second positional displacement regulating parts 9 may be placed on the placement part 5 to place the laminated iron core 13 on its plate 17. In this case, since the whole lower surface of the laminated iron core 13 makes surface contact with the plate 17, flexure of the laminated iron core 13 by gravity is prevented.

Figure 8:
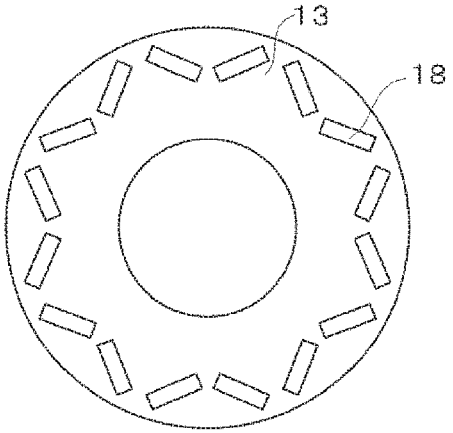
FIG. 8 is a plan view of a laminated iron core having a through hole.
Figure 9:
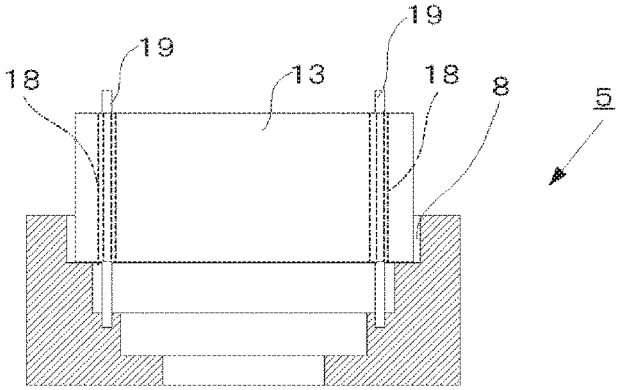
FIG. 9 is a diagram describing a modified example of the heat treatment method, and is a sectional view showing a state in which a pin is inserted into the through hole from an upper surface of the laminated iron core described in FIG. 8 and the pin is fixed to the placement part.

Also, when the laminated iron core 13 is formed with a through hole 18 vertically pierced in the laminated iron core 13 as shown in FIG. 8, a pin 19 may be inserted into the through hole 18 to fix the tip of the pin 19 to the placement part 5 as shown in FIG. 9. This can more surely prevent the positional displacement of the laminated iron core 13. In addition, in this case, it is necessary to previously form the placement part 5 with a hole into which the pin 19 is fitted. Also, in the case of using the plate 17, the plate 17 may be formed with a hole into which the pin 19 is fitted.

Figure 10:
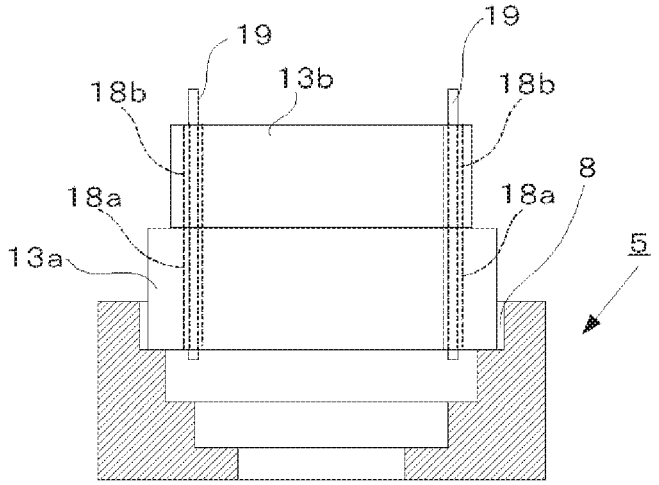
FIG. 10 is a diagram describing a modified example of the heat treatment method, and is a sectional view showing a state in which a different workpiece with a different size is placed on a workpiece placed on the placement part.

Also, as shown in FIG. 10, a different laminated iron core 13*b* with a different size can be placed on a laminated iron core 13*a* placed on the placement part 5. In the case shown in FIG. 10, the pin 19 is inserted into a through hole 18*a* vertically pierced in the laminated iron core 13*a* and a through hole 18*b* vertically pierced in the laminated iron core 13*b*. This pin 19 functions as a member for regulating a horizontal positional displacement of the laminated iron core 13*b* with respect to the laminated iron core 13*a*. Also, the pin 19 is inserted into the laminated iron core 13*a* and the laminated iron core 13*b*, but is not fixed to the placement part 5.

Figure 11:
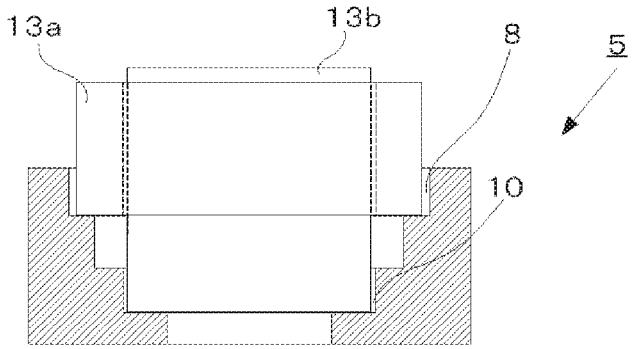
FIG. 11 is a diagram describing a modified example of the heat treatment method, and is a sectional view showing a state in which a second workpiece is arranged inside a tube of a first workpiece which is formed in an annular shape in a plane shape and is constructed in a generally tubular shape.

Also, as shown in FIG. 11, when the laminated iron core 13*a* is formed in an annular shape in a plane shape and is constructed in a generally tubular shape, that is, for example, when the laminated iron core 13*a* is an annular laminated iron core, the different laminated iron core 13*b* with the different size can also be arranged inside a tube of the laminated iron core 13*a*. In the case shown in FIG. 11, the lower end of the laminated iron core 13*a* abuts on a bottom surface of the first positional displacement regulating part 8, and a horizontal positional displacement of the laminated iron core 13*a* is regulated by the first positional displacement regulating part 8. The lower end of the laminated iron core 13*b* abuts on a bottom surface of the third positional displacement regulating part 10, and a horizontal positional displacement of the laminated iron core 13*b* is regulated by the third positional displacement regulating part 10.

As described above, the embodiment described above has the following effect roughly. Since the tray 1 includes the first positional displacement regulating part 8, the second positional displacement regulating part 9 and the third positional displacement regulating part 10 for respectively regulating the horizontal positional displacements of the plural workpieces with the different sizes, it becomes unnecessary to prepare a dedicated tray every size of the workpiece. Consequently, space for storing the tray can be decreased. As a result, use efficiency of the space of a factory is increased. Also, since setup change time necessary to change the workpiece can be reduced, productivity is increased.

The embodiment of the present invention and the modified examples have been described above, but these are illustrative of the concrete embodiment of this invention and are not intended to define the technical scope of this invention. The present invention can freely be modified, applied or improved within the technical idea described in the claims.

The "plural kinds of positional displacement regulating parts arranged concentrically in the plane shape" are not limited to the one in which the plural kinds of positional displacement regulating parts are arranged vertically as shown in FIGS. 2 to 5B. The plural kinds of positional displacement regulating parts may be arranged in the same horizontal plane. For example, when the laminated iron core 13*a* and the laminated iron core 13*b* respectively have rectangular shapes, the first positional displacement regulating part 8 for regulating the horizontal positional displacement of the laminated iron core 13*a* can be arranged by being rotated and turned around the central axis with respect to the second positional displacement regulating part 9 for regulating the horizontal positional displacement of the laminated iron core 13*b*.

Figure 12A:
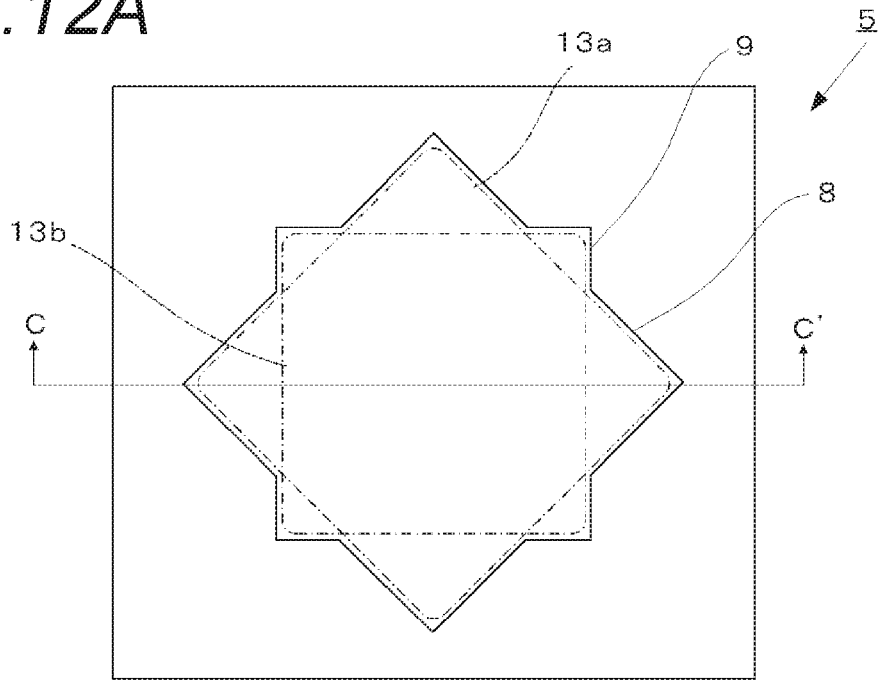
Figure 12B:
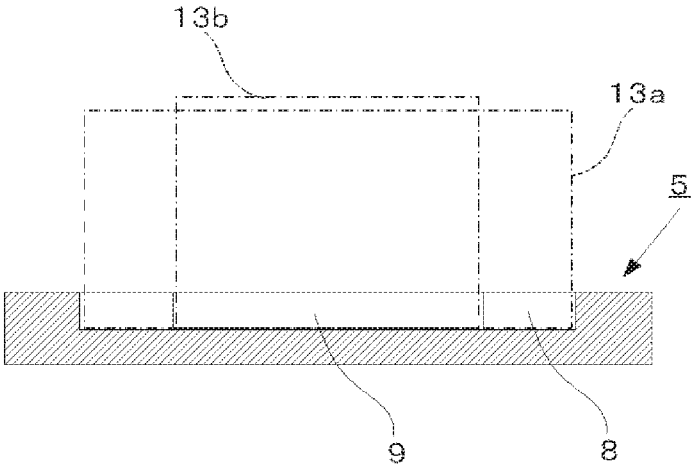

For example, as shown in FIG. 12A, when the first positional displacement regulating part 8 is arranged in a state inclined at 45° with respect to the second positional displacement regulating part 9, the corners of the first positional displacement regulating part 8 and the corners of the second positional displacement regulating part 9 are formed outside a contour of the second positional displacement regulating part 9 and a contour of the first positional displacement regulating part 8, respectively. As a result, the horizontal positional displacement of the laminated iron core 13*a* is regulated in the corners of the first positional displacement regulating part 8, and the horizontal positional displacement of the laminated iron core 13*b* is regulated in the corners of the second positional displacement regulating part 9, respectively. In this case, the first positional displacement regulating part 8 and the second positional displacement regulating part 9 can be arranged in the same horizontal plane. That is, as shown in FIG. 12B, a bottom surface of the first positional displacement regulating part 8 can be flush with a bottom surface of the second positional displacement regulating part 9.

Also, in the description of the embodiment described above, the laminated iron core 13 constructing the armature of the rotating electrical machine is illustrated as the concrete example of the workpiece placed on the tray 1, but the workpiece placed on the tray 1 is not limited to the laminated iron core 13 and the electrical component. Various workpieces such as a mechanical component or a structural component can be placed on the tray 1.

The configuration of the tray 1 shown in FIG. 1A is illustrative and is not limited to that shown in FIG. 1A. For example, a position in which the support tube 6 is arranged is not limited to the position between the placement parts 5. When the workpiece placed on the placement part 5 has an annular shape in the plane shape, that is, when the through hole is bored in the center of the workpiece, the support tube 6 can be arranged in the center of the placement part 5. Also, the adapter 14 may be configured integrally to the support tube 6. That is, in FIG. 1B, it may be constructed so that the support tube 6 is extended upwardly or downwardly and the extended portion functions as the adapter 14.

In FIG. 10, the laminated iron core 13*b* is illustrated as the different workpiece with the different size placed on the upper surface of the workpiece after the workpiece is placed on the tray. The laminated iron core 13*b* is smaller than the laminated iron core 13*a*. However, the "different workpiece with the different size" is not limited to the workpiece smaller than the workpiece thereunder and directly placed on the tray. The "different workpiece with the different size" may be a workpiece larger than the workpiece thereunder and directly placed on the tray. For example, in FIG. 10, the laminated iron core 13*b* may have a size overhanging from the laminated iron core 13*a*.

The "workpiece which is formed in the annular shape in the plane shape and is constructed in the generally tubular shape" is not limited to the cylindrical workpiece. The workpiece may be, for example, a workpiece formed in a rectangular shape in the plane shape, the center of the workpiece being formed with a through hole having a circular pipe shape. A cross-sectional shape of the through hole is not limited to the circle. The cross-sectional shape of the through hole may be, for example, a rectangular shape.

Also, the plane shape of the positional displacement regulating part (first positional displacement regulating part 8 etc.) is not limited to a circle, a rectangular shape or a circular arc. The plane shape of the positional displacement regulating part can be variously deformed according to the plane shape of the workpiece.

Also, FIG. 5A shows the example in which the first and second positional displacement regulating parts 8, 9 are respectively constructed of the two members. That is, the example in which the first and second positional displacement regulating parts 8, 9 are constructed of the two projections formed so as to surround a part of the contour of the workpiece in the plane shape is shown. However, the number of projections in this case is not limited to two. The first and second positional displacement regulating parts 8, 9 may be constructed of three or more projections.

In the embodiment described above, annealing is illustrated as the concrete example of the heat treatment, but the heat treatment conducted using the tray 1 is not limited to the annealing. As described in the related art, the heat treatment is a large concept including quenching, tempering, annealing, normalizing, oil quenching, blackening treatment, etc., and the present invention is widely applied to various heat treatment steps.

In the embodiment described above, the annealing furnace 15 is illustrated as the concrete example of the heat treatment furnace, but the heat treatment furnace to which the present invention is applied is not limited to the annealing furnace 15. Since the present invention is widely applied to various heat treatment steps as described above, the present invention is applied to steps of using various heat treatment furnaces. Also, the heat treatment furnace is not limited to a batch type heat treatment apparatus for conducting a single treatment. The present invention can also be applied to a step including a continuous type heat treatment apparatus for continuously conducting plural heat treatments, the apparatus in which heat treatment paths for conducting plural different treatments are arranged in series.

In the embodiment described above, the chain conveyor 16 is illustrated as a tool for conveying the tray 1 on which the laminated iron core 13 is placed, but the conveying tool is not limited to the chain conveyor 16. The conveying tool may be, for example, a belt conveyor or a roller conveyor.

The conveying tool may be a tool other than the conveyor. That is, the present invention can freely select various forms of a conveying tool.

In the embodiment described above, the example in which the plural trays 1 are laminated and are conveyed to the annealing furnace 15 is shown, but it may be constructed so that the tray 1 is carried in the heat treatment furnace one by one and treatment is conducted.

Also, raw materials and structures of the tray 1, plate 17 and the pin 19 are not particularly limited. Various raw materials and structures can be selected according to physical and chemical properties of the workpiece, a kind of heat treatment or a temperature condition.

1: TRAY
2: OUTER FRAME
3: TRANSVERSE BEAM
4: LONGITUDINAL BEAM
5: PLACEMENT PART
5*a*: BOARD UPPER SURFACE
6: SUPPORT TUBE
7: BRACKET
8: FIRST POSITIONAL DISPLACEMENT REGULATING PART
9: SECOND POSITIONAL DISPLACEMENT REGULATING PART
10: THIRD POSITIONAL DISPLACEMENT REGULATING PART
11: THROUGH HOLE
12: FOURTH POSITIONAL DISPLACEMENT REGULATING PART
13, 13*a*, 13*b*: LAMINATED IRON CORE
14: ADAPTER
15: ANNEALING FURNACE
15*a*: CARRY-IN PORT
15*b*: CARRY-OUT PORT
16: CHAIN CONVEYOR
17: PLATE
18, 18*a*, 18*b*: THROUGH HOLE
19: PIN

What is claimed is:

1. A tray for conveying a workpiece placed on the tray inside a heat treatment furnace, the tray comprising:

a plurality of positional displacement regulating parts having inside spaces with different sizes for respectively receiving plural kinds of workpieces with different sizes into the inside spaces so as to be supported on a corresponding bottom supporting surface of the respective inside spaces and for respectively regulating horizontal positional displacements of the plural kinds of workpieces, wherein the plurality of positional displacement regulating parts are arranged concentrically in a plane shape; and a through hole in communication with the inside spaces of the plurality of positional displacement regulating parts and penetrating the tray in a vertical direction of the tray.

2. The tray according to claim 1, wherein the positional displacement regulating parts are arranged on an upper surface and a lower surface of the tray.

3. The tray according to claim 1, wherein at least one of the positional displacement regulating parts is a recess formed so as to surround a whole periphery of a contour of the workpiece in the plane shape.

4. The tray according to claim 2, wherein at least one of the positional displacement regulating parts is a recess formed so as to surround a whole periphery of a contour of the workpiece in the plane shape.

5. The tray according to claim 1, wherein at least one of the positional displacement regulating parts includes a plurality of projections formed so as to surround a part of a contour of the workpiece in the plane shape.

6. The tray according to claim 2, wherein at least one of the positional displacement regulating parts includes a plurality of projections formed so as to surround a part of a contour of the workpiece in the plane shape.

7. A heat treatment method comprising:

placing a workpiece on a tray according to claim 1;

carrying the workpiece together with the tray in a heat treatment furnace;

heat-treating the workpiece in the heat treatment furnace; and then carrying the workpiece together with the tray out of the heat treatment furnace.

8. The heat treatment method according to claim 7, wherein a plate with a size corresponding to the workpiece is placed on the tray and the workpiece is placed on the plate such that the placing of the workpiece on the tray is an indirect placement.

9. The heat treatment method according to claim 7, wherein after the workpiece is placed on the tray, a pin is inserted from an upper surface of the workpiece and a tip of the pin is fixed to the tray.

10. The heat treatment method according to claim 7, wherein after the workpiece is placed on the tray, a different workpiece with a different size is placed on an upper surface of the workpiece.

11. The heat treatment method according to claim 10, wherein a pin is inserted from an upper surface of the different workpiece and the pin is inserted into the different workpiece and the workpiece.

12. The heat treatment method according to claim 7, wherein the workpiece includes a first workpiece and a second workpiece, and wherein the first workpiece, which is formed in an annular shape in a plane shape and is constructed in a generally tubular shape, is placed on the tray, the second workpiece is arranged inside the tube of the first workpiece and placed on the tray, and the first and second workpieces are respectively engaged with different ones of the positional displacement regulating parts.

13. The heat treatment method according to claim 7, wherein trays on which the workpieces are placed are laminated in plural stacks and the trays are carried in and out of the heat treatment furnace.

14. The heat treatment method according to claim 7, wherein the positional displacement regulating parts of the tray used in the heat treatment method are arranged on an upper surface and a lower surface of the tray.

15. The heat treatment method according to claim 7, wherein at least one of the positional displacement regulating parts of the tray used in the heat treatment method is a recess formed so as to surround a whole periphery of a contour of the workpiece in the plane shape.

16. The heat treatment method according to claim 14, wherein at least one of the positional displacement regulating parts of the tray used in the heat treatment method is a recess formed so as to surround a whole periphery of a contour of the workpiece in the plane shape.

17. The heat treatment method according to claim 7, wherein at least one of the positional displacement regulating parts of the tray used in the heat treatment method includes a plurality of projections formed so as to surround a part of a contour of the workpiece in the plane shape.

18. The heat treatment method according to claim 14, wherein at least one of the positional displacement regulating parts of the tray used in the heat treatment method includes a plurality of projections formed so as to surround a part of a contour of the workpiece in the plane shape.

19. The tray according to claim 1, wherein the through hole and the plurality of positional displacement regulating parts are arranged concentrically in the plane shape.

20. The tray according to claim 1, wherein the through hole has an inside space smaller than any of the inside spaces of the plurality of positional displacement regulating parts.

* * * * *